US007589754B2

(12) United States Patent
Sasaki

(10) Patent No.: US 7,589,754 B2
(45) Date of Patent: Sep. 15, 2009

(54) PRINTER

(75) Inventor: Wataru Sasaki, Asaka (JP)

(73) Assignee: FUJIFILM Corporation, Tokyo (JP)

( * ) Notice: Subject to any disclaimer, the term of this patent is extended or adjusted under 35 U.S.C. 154(b) by 529 days.

(21) Appl. No.: 11/337,490

(22) Filed: Jan. 24, 2006

(65) Prior Publication Data

US 2006/0176356 A1 Aug. 10, 2006

(30) Foreign Application Priority Data

Feb. 7, 2005 (JP) ..... 2005-030824

(51) Int. Cl.
*B41J 2/47* (2006.01)
*B41J 2/385* (2006.01)
*B41J 2/435* (2006.01)

(52) U.S. Cl. ..... 347/239; 347/136; 347/237; 347/255

(58) Field of Classification Search ..... 347/239, 347/136, 237, 255; 250/205
See application file for complete search history.

(56) References Cited

U.S. PATENT DOCUMENTS 6,222,509 B1 * 4/2001 Ohsawa et al. ..... 345/32
6,233,036 B1 * 5/2001 Masubuchi et al. ..... 355/38
6,603,522 B1 * 8/2003 Kaneko ..... 349/117
6,734,948 B2 * 5/2004 Futakami et al. ..... 355/32
2002/0063772 A1 * 5/2002 Sasaki ..... 347/239
2002/0134909 A1 * 9/2002 Shiota et al. ..... 250/205

FOREIGN PATENT DOCUMENTS

JP 4-39648 B2 6/1992
JP 6-52469 B2 7/1994
JP 7-9509 B2 2/1995
JP 2503464 B2 4/1996

* cited by examiner

*Primary Examiner*—Manish S Shah
*Assistant Examiner*—Sarah Al-Hashimi
(74) *Attorney, Agent, or Firm*—Sughrue Mion, PLLC

(57) ABSTRACT

After a voltage of opposite polarity is applied between electrodes of liquid crystal shutters for each of an odd number of colored lights emitted cyclically, a dummy operation of the liquid crystals is performed during a wait period until a next write command pulse is received. During the dummy operation, LEDs which emit the colored lights are kept off. Delays in response of the liquid crystals are reduced by driving the liquid crystals continuously, and molecular arrangement in the liquid crystals is kept constant whenever possible by performing an even number of shutter operations and thereby driving the liquid crystals for the same color with a voltage of the same polarity.

9 Claims, 14 Drawing Sheets

PRINTER

BACKGROUND OF THE INVENTION

1. Field of the Invention

The present invention relates to a printer which records a color image on a recording medium, by irradiating the recording medium cyclically with a plurality of colors while feeding the recording medium for use to record the image in a predetermined sub-scanning direction by a motor.

2. Description of the Related Art

Printers of the type described above include a printer which records color images on instant film sheets. While a motor is feeding an instant film sheet in a predetermined sub-scanning direction, the printer records a color image on the instant film sheet by irradiating the instant film sheet in the sub-scanning direction cyclically with emitted colors of red (R), green (G), and blue (B) from light-emitting elements in quantities corresponding to image data based on write command pulses synchronized with rotation of the motor. When recording is performed on an instant film sheet which is being transported, transport speed of the instant film sheet may change due to load changes, and thus some printers are equipped with an illuminating device which detects the transport speed of the instant film by an encoder and performs proper irradiation using an encoder signal outputted from the encoder in case of any change in the transport speed (see, for example, Japanese Patent Application No. 2004-070317).

With the technique disclosed in Japanese Patent Application No. 2004-070317, the instant film sheet is irradiated cyclically with colored lights from light-emitting elements in quantities corresponding to image data by adjusting the shutter speed of liquid crystal shutters arranged in the main scanning direction orthogonal to the sub-scanning direction.

When irradiating an instant film sheet with lights in quantities corresponding to shutter speeds of the liquid crystal shutters, the illuminating device must be equipped with a drive section which changes the liquid crystal shutters from a closed state to an open state, or from an open state to a closed state. By opening and closing the liquid crystal shutters at appropriate shutter speeds using the drive section, it is possible to irradiate an instant film sheet with colored lights in quantities corresponding to image data. Some liquid crystal shutters integrally incorporate a control circuit which opens and closes the liquid crystal shutters (see, for example, Japanese Patent Publication No. 07-9509). Besides, there are various types of liquid crystal, and the drive method of liquid crystals must be changed according to their type to bring out their potential. Thus, to bring out the maximum potential of liquid crystals, ingenuity is exercised in the manner in which signals are applied between electrodes of the liquid crystal shutters by the drive section (such as driving the liquid crystals using two drive signals of different frequencies or driving the liquid crystals with a bias electric field applied) (see, for example, Japanese Patent Publication No. 06-52469, Japanese Patent No. 2503464, and Japanese Patent Publication No. 04-39648).

If voltage of the same polarity is continued to be applied between electrodes of the liquid crystals to open and close the shutters as is done by the drive section according to the techniques described in the patent documents, DC-like electric fields are accumulated in the liquid crystals, and even after the voltage ceases to be applied between the electrodes (bringing about a field-free state), in some cases molecular arrangement in the liquid crystals does not return to its initial field-free state existing before the application of the voltage between the electrodes and is slightly tilted with respect to its original orientation in the initial field-free state.

To deal with this situation, the techniques disclosed in Japanese Patent Application No. 2004-070317 and the like continue to form AC-like electric fields in the liquid crystals by applying voltages of positive and negative polarities between electrodes of the liquid crystal shutters in sequence, and thereby prevent the molecular arrangement in the liquid crystals from being tilted in the field-free state.

Now description will be given of how conventional liquid crystal shutters are driven by the drive section in the illuminating device, with reference to FIG. 1.

FIG. 1 is an excerpt from drawings attached to Japanese Patent Application No. 2004-070317. FIG. 1 shows a timing relationship between an encoder signal ENC and liquid-crystal drive signal when the illuminating device mounted on the printer according to Japanese Patent Application No. 2004-070317 emits a round of three colored lights—R, G, and B—each time it receives a pulse. Incidentally, FIG. 1 shows an ideal encoder signal ENC which is a design center value.

The encoder signal ENC in FIG. 1 consists of a pulse train of pulses P1, P2, etc. These pulses P1, P2, etc. have ideal pulse intervals which are design center values. Incidentally, in FIG. 1, write times TR, TG, and TB for writing R, G, and B, respectively, according to the ideal pulse intervals are maximum values of exposure time needed to perform a round of writes.

The illuminating device of the printer according to Japanese Patent Application No. 2004-070317 emits a round of three colored lights—R, G, and B—each time it receives a pulse. Specifically, as shown in FIG. 1, it emits the R-colored light for the time TR starting at a rising edge of the pulse P1, the G-colored light for the time TG, and the B-colored light for the time TB.

In so doing, as shown in Part (c) of FIG. 1, the drive section in the illuminating device alternately applies voltages of positive (+) and negative (−) polarities between the electrodes of the liquid crystals, forming AC fields rather than DC fields in liquid crystals, and thereby preventing the molecular arrangement in the liquid crystals from being tilted in the field-free state.

However, since this printer provides a wait period (although referred to as a blank period TBL in FIG. 1, hereinafter the blank period will be referred to as a wait period) after a round of irradiation with the colored lights to adjust start timing of next irradiation (rising edge of the write command pulse P2) and thereby accommodate load changes, if transport speed is decreased, the wait period will be increased considerably.

FIG. 2 is a diagram illustrating a drive condition when transport speed of an instant film sheet is decreased.

As shown in Part (c) of FIG. 2, if transport speed of an instant film sheet is decreased, a cycle period of encoder pulses is increased, increasing a wait period (TBL in Part (d) of FIG. 2) after a round of writes. If the wait period is increased in this way, when a liquid crystal shutter is driven after the wait period, it responds differently compared to before the wait period.

FIG. 3 is a diagram showing how a response of a liquid crystal shutter varies with the length of a wait period. The vertical axis in FIG. 3 represents quantity of light passing through the liquid crystal shutter while the horizontal axis represents time. Incidentally, the liquid crystal shutter in FIG. 3 is a type which is closed when a voltage is applied between electrodes.

FIG. 3 shows a response waveform of the liquid crystal shutter when a stepwise voltage A is applied between the electrodes of liquid crystals to change the liquid crystal shutter from open state to closed state after a wait period of 4 msec and a response waveform of the liquid crystal shutter when a stepwise voltage A is applied between the electrodes of liquid crystals to change the liquid crystal shutter from open state to closed state after a wait period of 10 sec.

As shown in FIG. 3, a transient response waveform appearing during transition from open state to closed state tends to delay with increases in the wait period. If the response waveform appearing during transition from open state to closed state (or from closed state to open state) of the liquid crystal shutter changes in this way, any load change during transport of an instant film sheet will cause changes to the amount of exposure, resulting in color irregularities in a color image on the instant film sheet.

Also, although it is possible to put liquid crystals in the same open state (or closed state) by applying a voltage of either positive or negative polarity between electrodes, it is not possible to produce a precisely identical molecular arrangement in the liquid crystals using voltages of positive polarity and negative polarity. Referring to FIG. 1, although the drive section in the illuminating device alternately applies voltages of positive (+) and negative (−) polarities to produce an AC field in the liquid crystals, since there are an odd number (3) of light emitters, positive and negative voltages are alternately applied every other cycle in relation to each colored light.

Thus, due to physical properties in liquid crystals, there is a difference between the molecular arrangement resulting from application of a positive voltage and molecular arrangement resulting from application of a negative voltage in relation to each colored light. This can cause differences in the quantity of light passing through the liquid crystals.

This in turn can cause variations in the amount of exposure among write lines while the instant film sheet is being transported, resulting in color irregularities in a color image on the instant film sheet.

In this way, if the wait period until the next write is increased or voltages of different polarities are applied alternately to drive liquid crystals for each colored light, there can be color irregularities in a color image on the instant film sheet.

SUMMARY OF THE INVENTION

The present invention has been made in view of the above circumstances and provides a printer which can reduce color irregularities in color images and an illuminating device which, being mounted on the printer, helps reduce the color irregularities in color images.

The present invention provides a printer which records a color image on a recording medium, by irradiating the recording medium cyclically with a plurality of colors while relatively feeding the recording medium for use to record the image in a predetermined direction by a motor, including:

a light emitter which emits a plurality of different colored lights;

a liquid crystal shutter which is placed on an optical path shared by the plurality of colored lights emitted by the light emitter and controls irradiation of the recording medium with the colored lights by opening and closing by application of a voltage;

a pulse generating section which generates write command pulses synchronized with rotation of the motor;

an emission control section which makes the light emitter illuminate with the plurality of colored lights in sequence upon receiving one of write command pulses generated by the pulse generating section, and keeps the light emitter off during a wait period for a next write command pulse after a round of illumination with the plurality of colored lights is completed; and a shutter control section which controls the opening and closing of the liquid crystal shutter in synchronization with the sequential illumination of the light emitter with the plurality of colored lights so as to open the liquid crystal shutter individually for each colored light for a duration in accordance with an image signal as well as opens and closes the liquid crystal shutter even during the wait period.

With the printer according to the present invention, since the shutter control section opens and closes the liquid crystal shutter without fail even during the wait period when the light emitter is not illuminated, it is possible to avoid a situation in which the liquid crystal shutter is not driven for an extended period of time even if the wait period is prolonged.

That is, since the liquid crystal shutter is driven even during the wait period, it continues to be driven as long as the instant film sheet is transported. This reduces the possibility of a delay in the response of the liquid crystal shutter.

Even if there are an odd number of light emitters, the printer according to the present invention can drive the liquid crystal shutter an even number of times by keeping all the light emitters off during the wait period. Thus, if there are three colored lights as in the case of conventional printers, the printer according to the present invention can drive the liquid crystal shutter an even number of times by driving it once more during the wait period by keeping all the light emitters off. That is, even if there are an odd number of light emitters, the printer can always drive liquid crystals for the same color with a voltage of the same polarity as in the case where there are even number of colored lights by switching the polarity of a drive voltage among positive (R), negative (G), positive (B), and negative (dummy).

Consequently, even when generating an image using three colored lights as before, it is possible to avoid causing a difference between the molecular arrangement resulting from application of a positive voltage and molecular arrangement resulting from application of a negative voltage in relation to each colored light, and thereby avoid causing differences in the quantity of light passing through the liquid crystals.

This makes it possible to reduce delays in response by continuing to drive the liquid crystals during transport of the instant film sheet, maintain constant conditions in the liquid crystals using a drive voltage of the same polarity for each colored light, and thereby implement a printer with reduced color irregularities in color images.

In the printer, the light emitter may emit an odd number (or even number) of colored lights. The odd number (or even number) of colored lights may be either emitted by a single light emitter or emitted respectively by an odd number of (or an even number) of light emitters.

If an odd number of light emitters are used to emit three colored lights of red, green, and blue, preferably the light emitters are three LEDs which emit colored lights of red, green, and blue, respectively.

As described in Description of the Related Art, liquid crystal shutters are either closed or opened when a voltage is applied to them. The former are called a normally-white type while the latter are called a normally-black type.

Considering these two types of liquid crystal shutter, it is desired that the shutter control section is capable of driving the liquid crystal shutters differently according to their type.

For example, in the case of a normally-white liquid crystal shutter, preferably the shutter control section closes the liquid crystal shutter in response to a next write command pulse if the next write command pulse is received while the liquid crystal shutter is open in the wait period.

Normally, since normally-white liquid crystal shutters remain closed when a voltage is applied and remain open when no voltage is applied, when they are open in the wait period, no voltage is applied between their electrodes, i.e., they remain in a field-free state.

Thus, in the case of a normally-white liquid crystal shutter, upon receiving a write command pulse, it is preferable to form an electric field different in direction from the electric field formed at the time of the previous write command pulse, between the electrodes of the liquid crystals by applying a voltage opposite in polarity to the voltage applied at the time of the previous write command pulse.

That is, when driving a normally-white liquid crystal shutter, if a next write command pulse is received when the liquid crystal shutter is open in the wait period, preferably the liquid crystal shutter is closed.

On the other hand, in the case of a normally-black liquid crystal shutter, preferably if a next write command pulse is received while the liquid crystal shutter is open during the wait period, the shutter control section closes the liquid crystal shutter after keeping the liquid crystal shutter open for a predetermined period of time.

In the case of the normally-black liquid crystal shutter, which is opened when a voltage is applied between their electrodes, if a write command pulse is received, the liquid crystal shutter must be kept open for a predetermined period of time before it is closed. Otherwise, the molecular arrangement in the liquid crystals may get tilted depending on driving conditions at the time of the previous write command pulse.

Since the present invention is intended to prevent such a tilt, the liquid crystal shutter is kept open for a predetermined period of time before it is closed if it is a normally-black type.

Preferably, when the next write command pulse is received, the emission control section starts illuminating the light emitter in sequence after the liquid crystal shutter is closed.

As described above, during the wait period, the shutter is opened with the light emitter kept off. Consequently, the light emitter starts to be illuminated in sequence by the emission control section after the liquid crystal shutter is closed. If the light emitter started to illuminate in this state right on, the opening and closing speed of the liquid crystal shutter could not be controlled correctly.

When the emission control section starts illuminating the light emitter in sequence after the liquid crystal shutter is closed as described above, the shutter speed is controlled correctly, reducing color imperfections considerably.

Preferably, the shutter control section sets an open period of the liquid crystal shutter during the wait period equal to an open period of the liquid crystal shutter immediately before the wait period.

As described above, in the case of a normally-black liquid crystal shutter, when a write command pulse is received, preferably the liquid crystal shutter is kept open for a predetermined period of time before it is closed. Furthermore, if a voltage of opposite polarity is applied to the liquid crystal shutter for a period equal to the open period of the liquid crystal shutter immediately before the wait period, an electric field, which is equal in intensity to the electric field formed by the opening of the liquid crystal shutter immediately before the wait period and which is completely opposite in direction, is formed in the liquid crystals, preventing the molecular arrangement in the liquid crystals from being tilted in the field-free state.

The shutter control section may set an open period of the liquid crystal shutter during the wait period equal to the difference between the sum of open periods for odd-numbered colored lights and sum of open periods for even-numbered colored lights in a round of illumination with the colored lights immediately before the wait period.

In the printer according to the present invention, if the liquid crystal shutter is driven by application of a positive voltage and by application of a negative voltage for an equal length of time regardless of whether the liquid crystal is a normally-black type or normally-white type, electric fields are formed in the liquid crystals in a balanced manner, reducing the tilt.

As described above, by always driving liquid crystals for the same color with a voltage of the same polarity when adjusting quantities of multiple colored lights, it is possible to keep the molecular arrangement in the liquid crystals constant and prevent delays in response, and thereby provide a printer which can reduce color irregularities in color images.

Also, the present invention provides an illuminating device which irradiates a target body cyclically with a plurality of colors, including:

a light emitter which emits a plurality of different colored lights;

a liquid crystal shutter which is placed on an optical path shared by the plurality of colored lights emitted by the light emitter and controls irradiation of the target body with the colored lights by opening and closing by application of a voltage;

an emission control section which makes the light emitter illuminate with the plurality of colored lights in sequence upon receiving one of predetermined timing pulses, and keeps the light emitter off during a wait period for a next write command after a round of illumination with the plurality of colored lights is completed; and a shutter control section which controls the opening and closing of the liquid crystal shutter individually for each colored light in synchronization with the sequential illumination of the light emitter with the plurality of colored lights as well as opens and closes the liquid crystal shutter even during the wait period.

The illuminating device according to the present invention allows the target body to be irradiated with appropriate quantities of colored lights, making it possible to obtain sharp color images with desired color tones on the target body.

The illuminating device is applicable to any apparatus (e.g., a liquid crystal display panel) that forms images by driving liquid crystals.

The present invention makes it possible to implement a printer which can reduce color irregularities in color images and an illuminating device which, being mounted on the printer, helps reduce the color irregularities in color images.

DETAILED DESCRIPTION OF THE INVENTION

An embodiment of the present invention will be described below.

Figure 4:
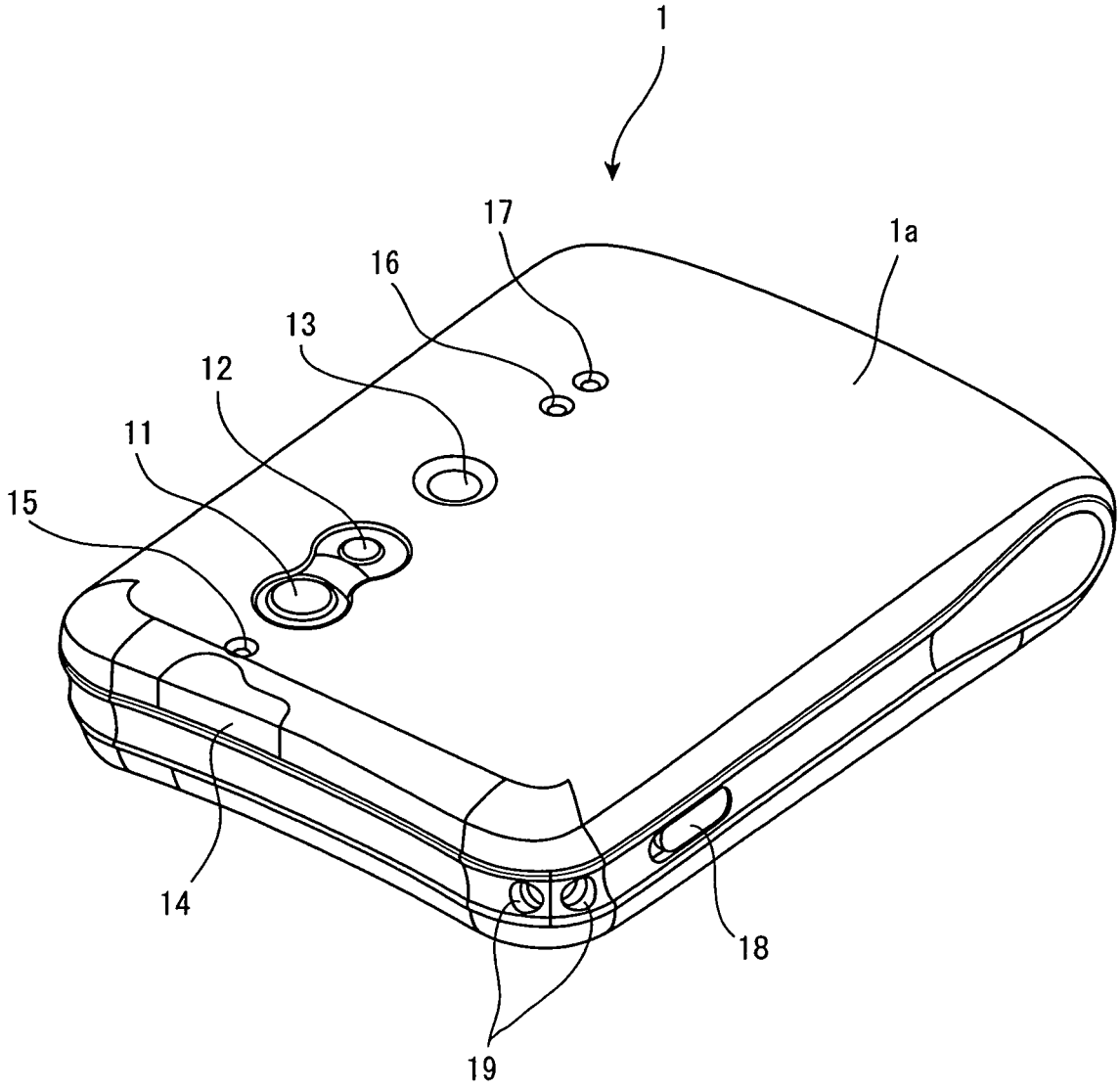
FIG. 4 is a perspective view of a printer, which is an embodiment of the present invention, as viewed obliquely from the front.

FIG. 4 is a perspective view of a printer 1, which is an embodiment of the present invention, as viewed obliquely from the front.

The printer 1 is used in combination with a cell phone or the like. A media compartment is loaded with an instant film pack containing a stack of instant film sheets (ten sheets in this case) on which a latent image is formed by exposure and then visualized by a developer during delivery. An instant film sheet is exposed according to image data and the developer is applied to it while the instant film sheet is being sent out. The instant film sheet is an example of the recording medium according to the present invention. Although the instant film sheet is used here as the recording medium, the printer may use a light emitter, a photosensitive drum, and toner.

Some cell phones are capable of infrared communication compliant with IRDA (InfraRed Data Association). They can send their own information to other information equipment via the infrared communication. In the case of a camera-equipped cell phone, image data can be sent to the printer 1.

Upon receiving image data of an image shot by the camera-equipped cell phone or image data sent to the camera-equipped cell phone via mail, the printer 1 records the image on an instant film sheet based on the image data. Besides, the printer 1 can record the image again on another instant film sheet based on the image data by simple manipulation of a repeat switch (described later) even if the image data is not retransmitted from the cell phone.

The printer 1 is a portable printer with a small, thin, light-weight structure as shown in FIG. 4. It contains two 3-V primary batteries. A housing 1*a* of the printer 1 is loaded with an instant film pack containing a stack of ten instant film sheets, on each of which an image is to be recorded.

Operation buttons are provided on the top face of the housing 1*a* of the printer 1: a power switch (hereinafter referred to as the power SW) 11 used to turn on and off the printer 1 and a repeat switch (hereinafter referred to as the repast SW) 12 used to re-record images based on transmitted image data. Also, a counter 13 which indicates the number of remaining instant film sheets is provided on the top face of the housing 1*a*. The counter 13 is a mechanical one which displays a numeric value of "10" when a new instant film pack is loaded, indicating that the number of remaining instant film sheets is 10. Subsequently, the number is decremented by one each time an image is recorded on an instant film sheet until an image is recorded on the tenth instant film sheet and a numeric value of "0" is displayed indicating that the number of remaining instant film sheets is 0. Incidentally, when the instant film pack is pulled out, the counter 13 becomes blank, displaying nothing.

An end of the printer 1 is equipped with a receiver/transmitter section 14 to receive image data transmitted through infrared communication and send a signal notifying the partner 1 about the reception.

Furthermore, the housing 1*a* of the printer 1 is equipped with a power LED 15 which glows when the printer 1 is turned on and blinks during infrared communication, communications error LED 16 which glows in case of error in infrared communication, and a battery indicator LED 17 which glows when the built-in batteries get low, prompting the user to replace the batteries.

Also, a film door opening switch 18 is provided on a flank of the printer 1 to open a film door (described later) installed on the underside of the printer 1 while a strap mount 19 is provided at a corner.

Figure 5:
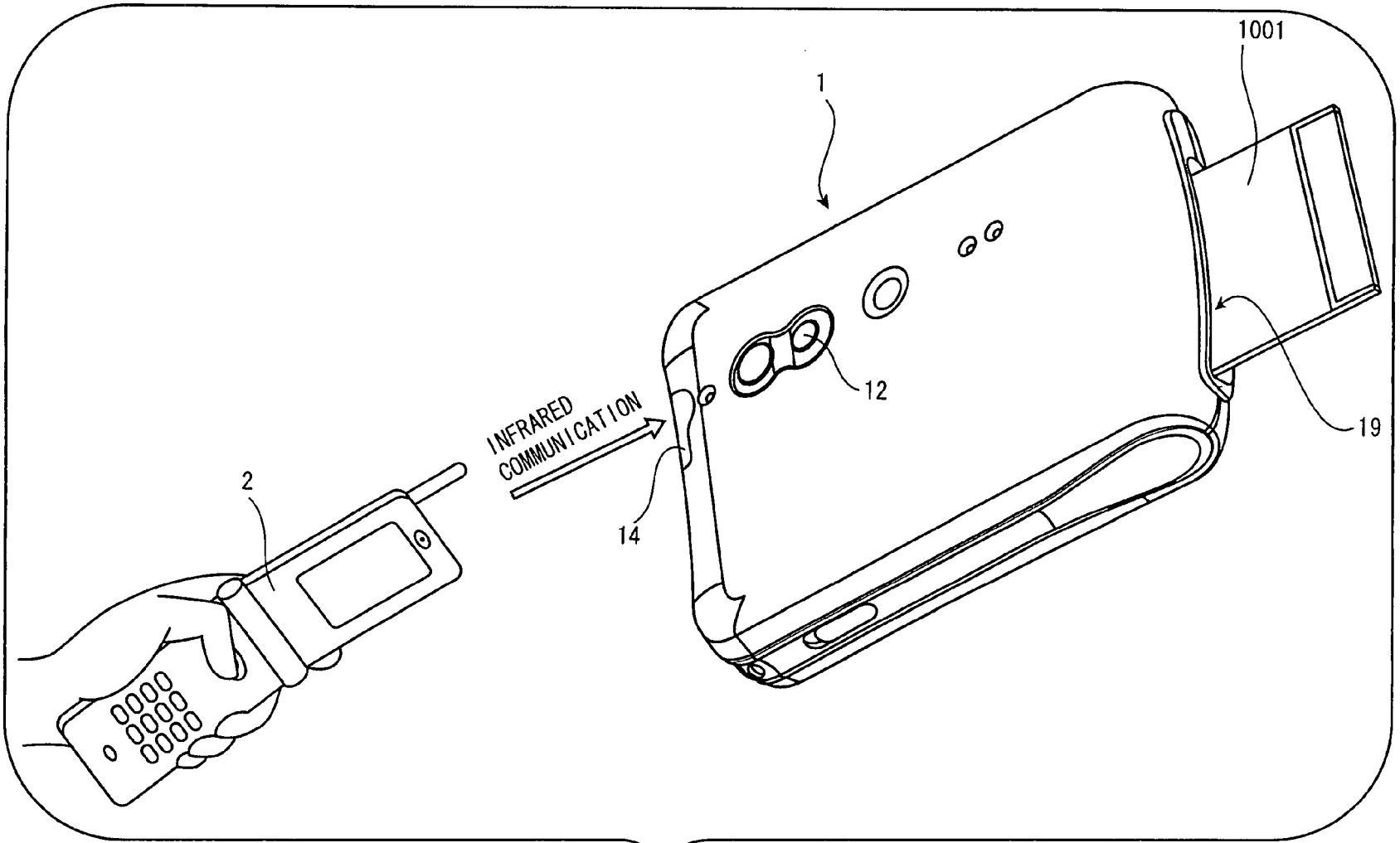
FIG. 5 is a diagram showing how the printer shown in FIG. 4 ejects an instant film sheet on which an image is recorded based on image data received from a camera-equipped cell phone.

FIG. 5 is a diagram showing how the printer shown in FIG. 4 ejects an instant film sheet on which an image is recorded based on image data received from a camera-equipped cell phone.

With an infrared communications section of a camera-equipped cell phone 2 directed at the receiver/transmitter section 14 of the printer 1, the user operates the camera-equipped cell phone 2 to send image data of an image taken by the camera-equipped cell phone 2 to the printer 1 through infrared communication. The printer 1 receives the image data transmitted through infrared communication, records a latent image based on the received image data on an instant film sheet 1001 by exposure, develops the instant film sheet 1001, and ejects the instant film sheet 1001 gradually through an output port 19 of the printer 1. Subsequently, if the repeat SW 12 (see FIG. 4) is pressed, the same image is re-recorded on another instant film sheet 1001.

Figure 6:
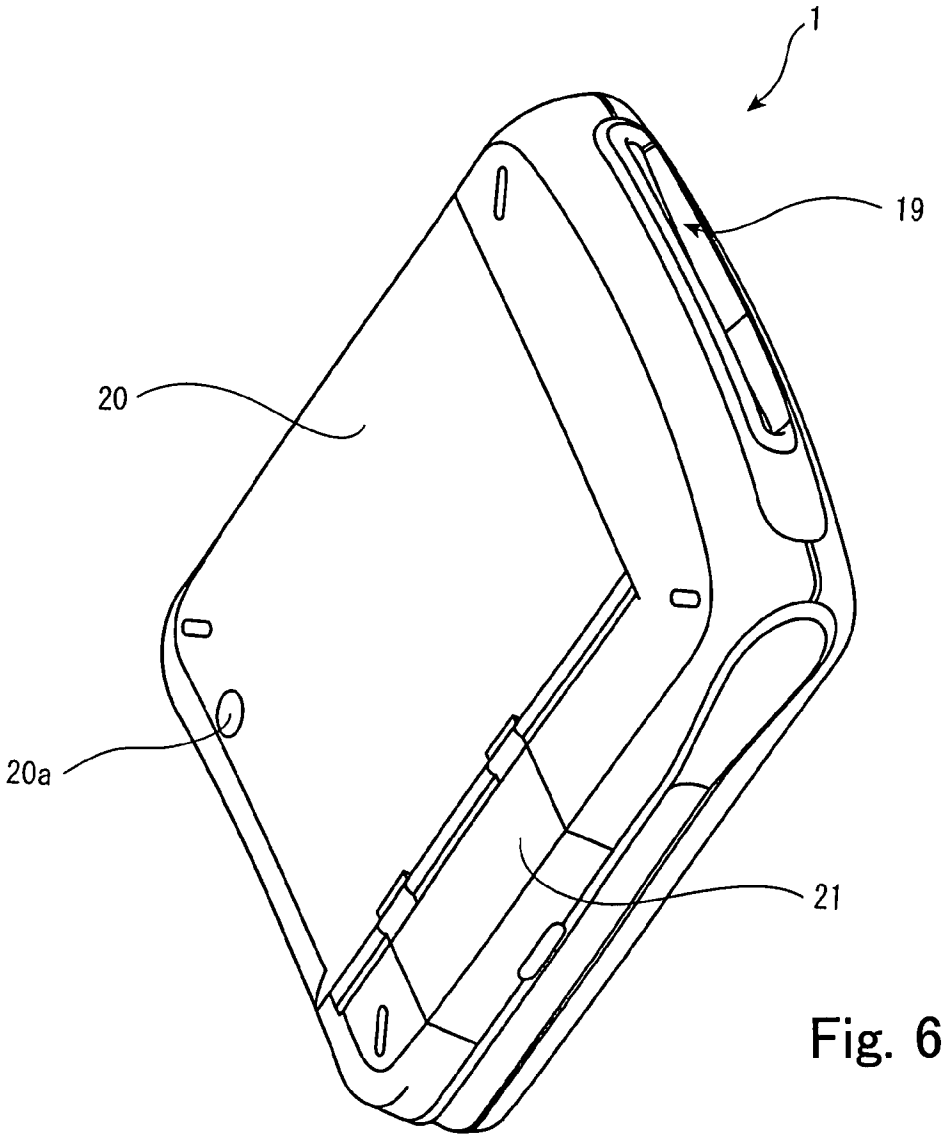
FIG. 6 is a perspective view of the printer in FIG. 4 as viewed obliquely from below, showing the under side thereof.

FIG. 6 is a perspective view of the printer in FIG. 4 as viewed obliquely from below, showing the underside thereof.

On the underside of the printer 1, there is a film door 20 which is opened by means of the film door opening switch 18 (see FIG. 4). An instant film pack is loaded in the media compartment through the opened film door 20. Also, a pack confirmation window 20*a* is provided on the film door 20 to check whether an instant film pack has been loaded. Besides, a battery lid 21 is provided next to the film door 20. It is opened to mount batteries which supply power to the printer 1.

Figure 7:
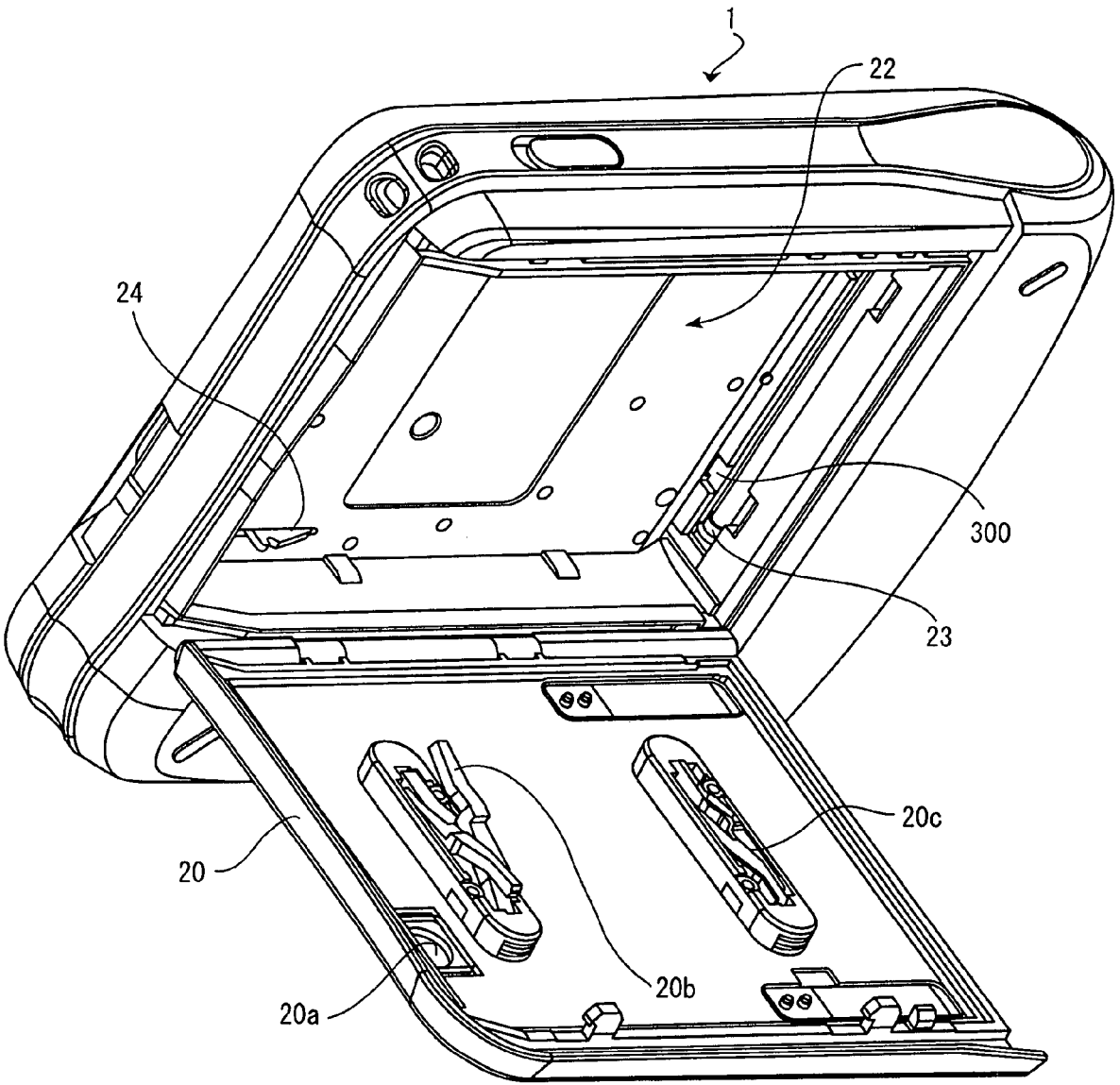
FIG. 7 is a perspective view of the printer in FIG. 4 with its film door open.

FIG. 7 is a perspective view of the printer in FIG. 4 with its film door 20 open.

In addition to the pack confirmation window 20*a* described above, spring members 20*b* and 20*c* are provided on the inner side of the film door 20 to press the instant film sheets stacked in the instant film pack to the top face of the printer 1.

The printer 1 is equipped with a media compartment 22 to be loaded with an instant film pack. In right part of FIG. 7, outside the media compartment 22, there are an image write section 300 (described later) and a transport roller 23 of a transport mechanism which transports the instant film sheets. In a lower part of FIG. 7, in the media compartment 22, there is a claw 24 for use to send out instant film sheets to the image write section 300 and transport roller 23. With this configuration, the uppermost one of the instant film sheets in the instant film pack is pushed up by the claw 24 and transported by the transport roller 23, and in the meantime an image is recorded on it by the image write section 300.

Figure 8:
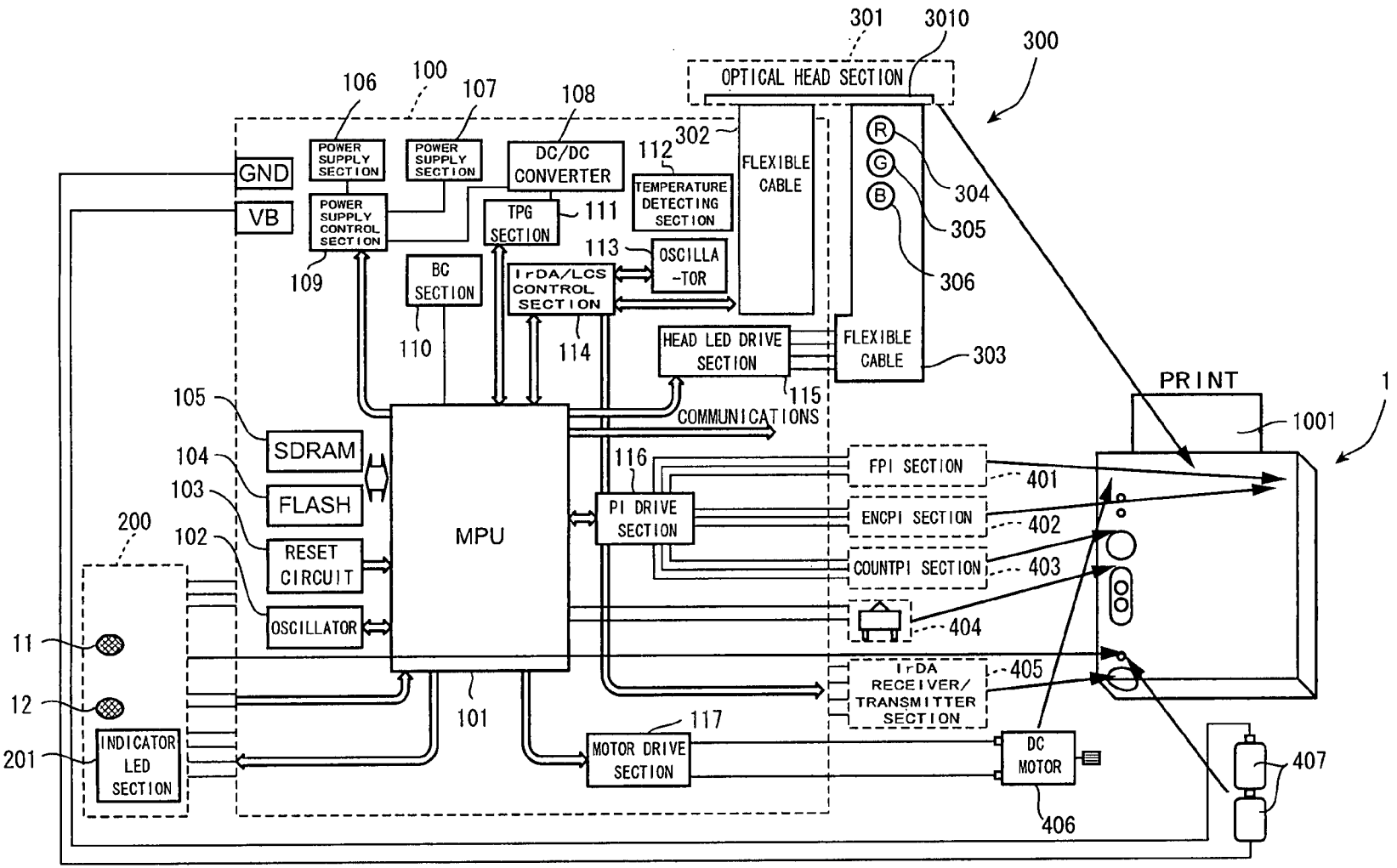
FIG. 8 is a schematic block diagram showing a control system in the printer.

FIG. 8 is a schematic block diagram showing a control system in the printer.

The entire area of FIG. 8 shows configuration of the control system of the printer 1 except for the right end which schematically shows the printer 1 shown in FIG. 4. Incidentally, the solid arrows in FIG. 8 indicate relative locations of components of the control system of the printer 1.

The printer 1 has a main board 100, a sub-board 200, the image write section 300, an FPI section 401, an ENCPI section 402, a COUNTPI section 403, a cam switch 404, an IrDA receiver/transmitter section 405 installed in the receiver/transmitter section 14 described above, and a DC motor 406.

The sub-board 200 contains the power SW 11 and repeat SW 12 described above as well as an indicator LED section 201. The indicator LED section 201 includes the power LED 15, communications error LED 16, and low battery indicator LED 17 shown in FIG. 4 as well as a counter backlight LED (not shown) mounted on the backside of the counter 13.

The image write section 300 includes an optical head section 301 equipped with an optical guide, liquid crystal shutters (LCS), etc.; flexible cables 302 and 303 which connect the optical head section 301 with the main board 100; and red (R), green (G), and blue (B) light-emitting elements (LED) 304, 305, and 306 mounted on the flexible cable 303. The image write section 300 writes a latent image on an instant film sheet being transported, by irradiating it with three colored lights of R, G, and B from the LEDs 304, 305, and 306 cyclically in synchronization with write command pulses (described later), but details will be described later. The printer 1 contains two 3-V primary batteries 407.

The main board 100 will be described below. A 6-V power supply voltage VB is applied to the main board 100 from the primary batteries 407 connected in series. The main board 100 is equipped with an MPU (Micro Processor Unit) 101, oscillator 102, reset circuit 103, flash memory (denoted as FLASH in FIG. 8) 104, and SDRAM 105.

The MPU 101 totally controls the operation of the printer 1.

The oscillator 102 generates a predetermined oscillatory signal and supplies it as an operation clock signal to the MPU 101.

The reset circuit 103 outputs a reset signal to initialize the MPU 101.

The flash memory 104 is a non-volatile memory. It stores adjustment values and the like for adjustment of individual differences which depend on the mechanism and the like unique to the printer 1.

The SDRAM 105 is a volatile memory. It stores image data and the like received from the camera-equipped cell phone 2.

The main board 100 is equipped with a power supply section 106, power supply section 107, and DC/DC converter 108 which receive the 6-V power supply voltage VB and output a 2.5-V voltage, 3.3-V voltage, and 15-V voltage, respectively. It is also equipped with a power supply control section 109 which controls the power supply sections 106 and 107 and the DC/DC converter 108 on instructions from the MPU 101. The 2.5-V voltage is supplied to the MPU 101 and the 3.3-V voltage is supplied to peripheral circuits other than the MPU 101. The 15-V voltage is used to drive an LCD described later.

To prolong the life of the primary batteries 407, the MPU 101 of the printer 1 has a standby mode, which is a power saving mode. If the power SW 11 is pressed, the MPU 101 enters the standby mode after initialization is completed. In this state, if infrared communication is conducted from outside, the MPU 101 switches from standby mode to normal operation mode, records an image on an instant film sheet, and switches from normal operation mode to standby mode quickly. Also, when the repeat SW 12 is pressed, the MPU 101 records an image on an instant film sheet and then enters standby mode. The MPU 101 controls the power supply sections 106 and 107 and the DC/DC converter 108 via the power supply control section 109 so that power is supplied to various components only when necessary. This makes it possible to use the printer 1 on the built-in primary batteries 407 for a prolonged period of time.

Furthermore, the main board 100 is equipped with a BC section 110, TPG section 111, temperature detecting section 112, oscillator 113, IrDA/LCS control section 114, and head LED drive section 115.

The BC section 110 checks whether the power supply voltage VB of the built-in primary batteries 407 is lower than a predetermined value. If it is found, based on the results of the check, that the power supply voltage VB of the built-in primary batteries 407 is lower than the predetermined value, the MPU 101 illuminates the low battery indicator LED 17, prompting the user to replace the batteries.

The TPG section, 111 turns on and off the 15-V voltage outputted from the DC/DC converter 108.

The temperature detecting section 112 detects temperature of the image write section 300. The MPU 101 controls the shutter speeds and the like of liquid crystal shutters 3010 in a liquid crystal shutter array in the optical head section 301 based on a detection signal from the temperature detecting section 112.

The liquid crystal shutters 3010 are placed on an optical path shared by multiple colored lights emitted by the three LEDs 304, 305, and 306 which are light emitters mounted on the flexible cable 303. On instructions from the MPU 101 and under the control of the IrDA/LCS control section 114, the liquid crystal shutters 3010 control irradiation of the instant film sheet with the colored lights by opening and closing based on a voltage applied between their electrodes via the other flexible cable 302. The head LED drive section 115 drives the three LEDs 304, 305, and 306 mounted on the flexible cable 303 by passing current through them via the flexible cable 303 based on instructions from the MPU 101.

The IrDA/LCS control section 114 which controls the liquid crystal shutters (LCS) 3010 controls the IrDA receiver/transmitter section 405 and optical head section 301 based on the oscillatory signal from the oscillator 113. The IrDA receiver/transmitter section 405 is equipped with a photo-transmitter and photo-receiver, and the IrDA/LCS control section 114 sends data produced by the photo-receiver as a result of photoelectric conversion to the MPU 101 and sends data from the MPU 101 via the photo-transmitter, notifying external devices to that effect. Also, the IrDA/LCS control section 114 controls the opening and closing of the liquid crystal shutters 3010 of the optical head section 301 according to image data by applying a voltage between their electrodes via the flexible cable 302 based on instructions from the MPU 101.

To make the IrDA/LCS control section 114 control the opening and closing of the liquid crystal shutters (LCS) 3010, the MPU 101 supplies the IrDA/LCS control section 114 with an encoder signal as it is received from the ENCPI section 402. While making the IrDA/LCS control section 114 control the opening and closing of the liquid crystal shutters (LCS) 3010, the MPU 101 makes the head LED drive section 115 illuminate the LEDs 304, 305, and 306 in respective colors in sequence based on each write command pulse and keep the LEDs 304, 305, and 306 off during a wait period for a next write command pulse after a round of illumination by the multiple colored lights is completed.

That is, the MPU 101 makes the IrDA/LCS control section 114 control the opening and closing of the liquid crystal shutters 3010 in synchronization with the sequential illumination of the LEDs 304, 305, and 306 by the multiple colored lights so as to open liquid crystal shutters 3010 individually for each colored light for a duration in accordance with an image signal as well as to open and close the liquid crystal shutters 3010 even during the wait period.

The MPU 101 and IrDA/LCS control section 114 correspond to the shutter control section according to the present invention while the MPU 101 and LED drive section 115 correspond to the emission control section according to the present invention.

The MPU 101, IrDA/LCS control section 114, head LED drive section 115, and image write section 300 constitute the illuminating device according to the present invention. In this embodiment, the illuminating device which can suitably drive liquid crystals is applied to a printer which uses instant film sheets as a recording medium.

As described above, while feeding an instant film sheet in a predetermined sub-scanning direction (feed direction of the instant film sheet) using the motor 406, the printer 1 according to this embodiment irradiates the instant film sheet with three colored lights of R, G, and B from the LEDs 304, 305, and 306 cyclically and writes a single color at a time into all pixels arranged in the main scanning direction orthogonal to the sub-scanning direction. In this way, the printer 1 records a latent image based on image data on the instant film sheet 1001 by exposure, develops the instant film sheet 1001, and ejects the instant film sheet 1001 gradually through an output port 19 of the printer 1.

To record the latent image on the instant film sheet, as described above, the MPU 101 makes the LED drive section 115 control the illumination of the LEDs 304, 305, and 306 mounted on the flexible cable 303 and at the same time, makes the IrDA/LCS control section 114 open and close the liquid crystal shutters 3010, irradiate the instant film sheet with colored lights in sequence, and thereby record the latent image on the entire instant film sheet.

Now, driving of liquid crystals during a wait period which is a characteristic portion of the present invention will be described in detail.

In order to describe the characteristic portion of the present invention, before describing the driving of liquid crystals in detail, description will be given of configuration for, and operation of, feedback control which is a reason why the wait period occurs.

Feedback control is performed here to transport the instant film sheet at a constant speed. Thus description will be given of configuration of the following components with reference to FIG. 8: a detecting section which is needed for the feedback control, the MPU 101 which controls rotation of a motor based on detection results produced by the detecting section, and a motor drive section 117.

As shown in FIG. 8, the main board 100 is equipped with a PI drive section 116 which controls the FPI section 401, ENCPI section 402, and COUNTPI section 403 which correspond to the detecting section.

The FPI section 401 is a photointerrupter which detects transport condition of an instant film sheet and outputs a film signal FILM_PI described later. In the initial state in which instant film sheets are contained in the instant film pack, the FPI section 401 outputs the film signal FILM_PI in high (H) state. In the high (H) state, when an instant film sheet is transported by rotation of the motor 406 and its front end is detected by the FPI section 401, the film signal FILM_PI changes from high (H) to low (L). Then, when the instant film sheet continues to be transported and its rear end is detected, the film signal FILM_PI changes from low (L) to high (H).

The ENCPI section 402 is a photointerrupter which outputs an encoder signal ENC (described later) consisting of pulse trains synchronized with the rotation of the motor 406. The ENCPI section 402 outputs pulse trains synchronized with the rotation of the motor 406: if the transport speed of the instant film sheet being transported increases due to a load change, it outputs short-period pulse trains in synchronization with the increased transport speed and if the transport speed decreases, it outputs long-period pulse trains in synchronization with the decreased transport speed.

The COUNTPI section 403 is a photointerrupter which detects whether the counter 13 is reset (the instant film pack is pulled out) and is not directly involved in transport control.

Furthermore, the cam switch 404 is provided to keep the transport speed of the instant film sheet constant, it is connected to the main board 100 and used to monitor the initial position of the transport mechanism of the printer 1. When the transport mechanism is at the initial position, the cam switch 404 outputs a cam switch signal CAMSW in high (H) state. When the transport mechanism leaves the initial position along with rotation of the motor 406, the cam switch signal CAMSW changes from high (H) to low (L), allowing the MPU 101 to sense that the transport mechanism is in operation.

Figure 9:
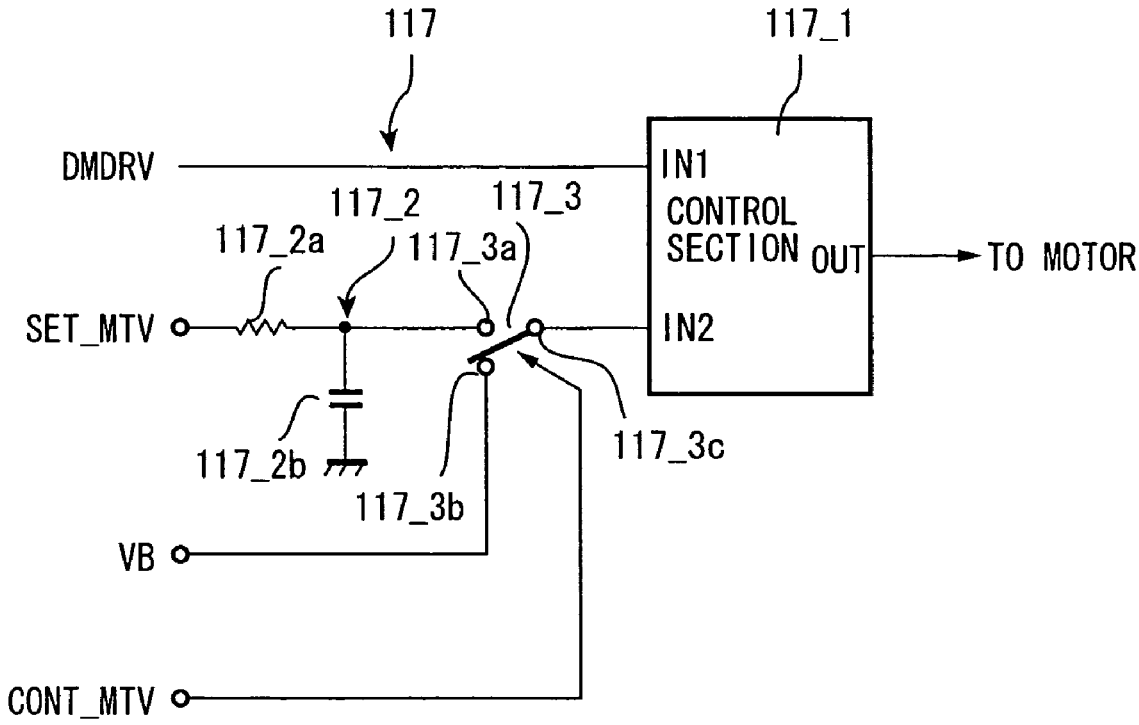
FIG. 9 is a diagram showing a circuit of the motor drive section shown in FIG. 8.
Figure 10:
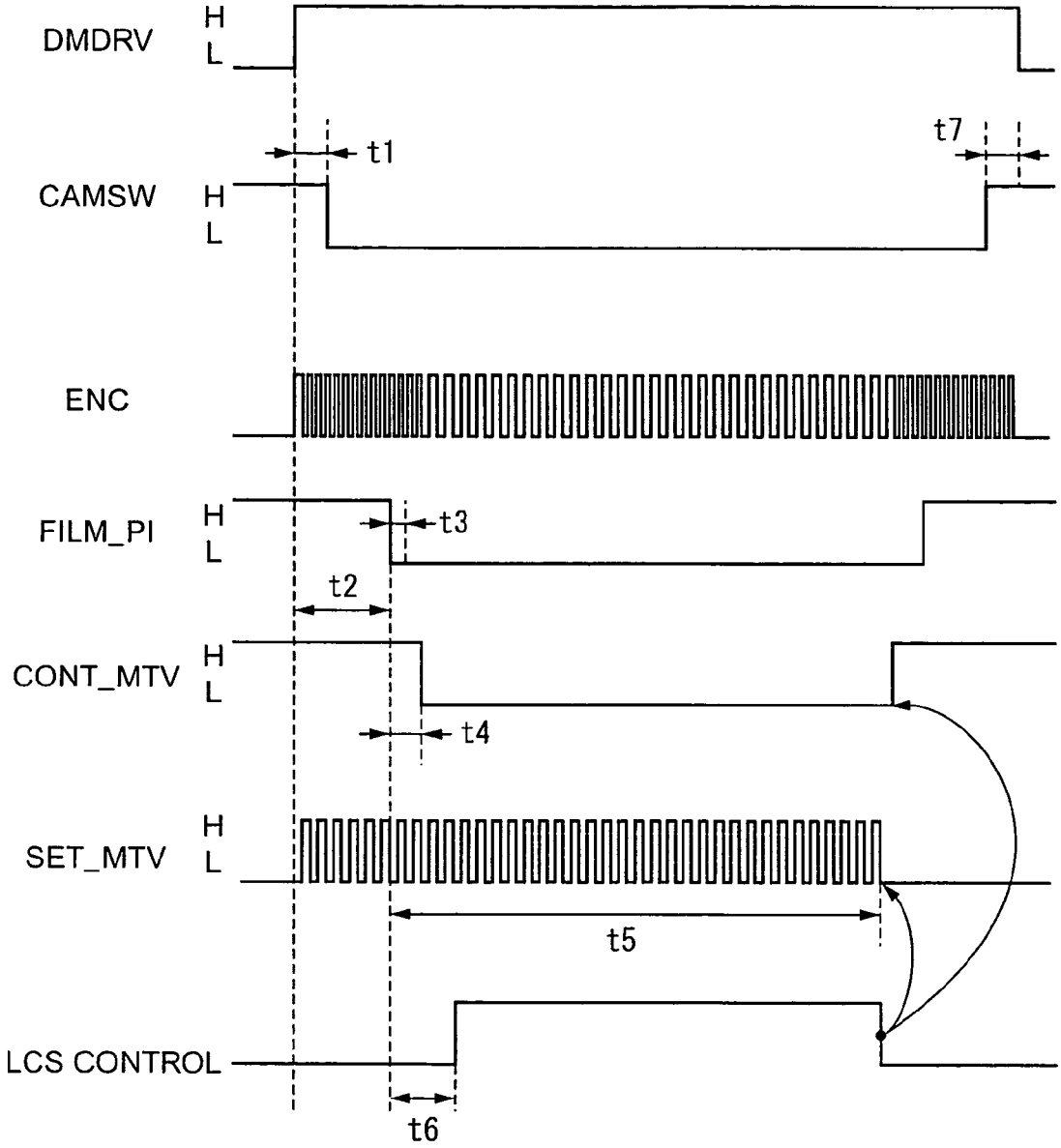
FIG. 10 is a timing chart of the circuit in the motor drive section shown in FIG. 9.

FIG. 9 is a diagram showing a circuit of the motor drive section 117 shown in FIG. 8. FIG. 10 is a timing chart of the circuit in the motor drive section 117 shown in FIG. 9.

The motor drive section 117 shown in FIG. 9 is equipped with a control section 117_1, integration circuit 117_2, and switch circuit 117_3, where the integration circuit 117_2 consists of a resistive element 117_2*a* and capacitive element 117_2*b* while the switch circuit 117_3 consists of contacts 117_3*a*, 117_3*b*, and 117_3*c*. The switch circuit 117_3 operates based on a motor control signal CONT_MTV from the MPU 101.

A motor drive signal DMDRV from the MPU 101 is entered in an input IN1 of the control section 117_1. A pulse signal SET_MTV is inputted in the integration circuit 117_2 from the MPU 101 to keep the rotation of the DC motor 406 constant. The 6-V power supply voltage VB of the primary batteries 407 is applied to the contact 117_3*b* of the switch circuit 117_3.

As shown in FIG. 10, in the initial state, the motor drive signal DMDRV of the MPU 101 is low (L), the cam switch signal CAMSW from the cam switch 404 is high (H), the film signal FILM_PI from the FPI section 401 is high (H), and the motor control signal CONT_MTV from the MPU 101 is high (H). Consequently, the contacts 117_3*b* and 117_3*c* of the switch circuit 117_3 are connected, allowing the 6-V power supply voltage VB to be entered in an input IN2 of the control section 117_1.

Then, the motor drive signal DMDRV is changed from low (L) to high (H) by the MPU 101. In response, the control section 117_1 outputs the 6-V power supply voltage VB entered in the input IN2 to the motor 406 through an output OUT. The motor 406, to which the 6-V power supply voltage VB is applied, rotates at a high speed, causing the instant film sheet to be transported at a high speed. Also, an encoder signal ENC is outputted in synchronization with the rotation of the motor 406. Then, a pulse signal SET_MTV with a predetermined duty ratio is inputted in the integration circuit 117_2 from the MPU 101. The integration circuit 117_2 generates a control voltage corresponding to the duty ratio of the pulse signal SET_MTV.

After a lapse of time t1 from the time when the motor drive signal DMDRV changes from low (L) to high (H), the cam switch signal CAMSW changes from high (H) to low (L). Also, since the DC motor 406 is rotating at a high speed, the encoder signal ENC outputted in synchronization with the rotation of the DC motor 406 is relatively short.

After a lapse of time t2 longer than time t1, the front end of the instant film sheet is detected and the film signal FILM_PI changes from high (H) to low (L). In response, the MPU 101 performs feedback control which involves monitoring the rotation of the DC motor 406 and changing the duty ratio of the pulse signal SET_MTV to keep the rotation of the DC motor 406 constant. The pulse signal SET_MTV under feedback control is inputted in the integration circuit 117_2. The integration circuit 117_2 generates a control voltage according to the duty ratio. After a lapse of time t4 longer than chattering time t3 of the film signal FILM_PI from time t2, the MPU 101 changes the motor control signal CONT_MTV from high (H) to low (L). Consequently, the contact 117_3*a* and contact 117_3*c* of the switch circuit 117_3 are connected with each other, and a control voltage which is determined by the integration circuit 117_2 and is lower than the 6-V power supply voltage VB is entered in the input IN2 of the control section 117_1. The control section 117_1 outputs the control voltage to the motor 406 from the output OUT. The DC motor 406 rotates at a constant speed since the control voltage is applied to the motor 406. Consequently, the instant film sheet is also transported at a constant speed.

After a lapse of time t6 longer than the time t4 from the time t2, liquid crystal shutter control (LCS control) is performed and the instant film sheet is irradiated with colored lights and the image is recorded as described above. After a lapse of time t5 from the time when the film signal FILM_PI changes from high (H) to low (L), when the LCS control is finished, the MPU 101 stops to output the pulse signal SET_MTV. Also, the MPU 101 changes the motor control signal CONT_MTV from low (L) to high (H). Consequently, the 6-volt power supply voltage VB is applied to the motor 406 to rotate the motor 406 at a high speed. Consequently, the instant film sheet is transported at a high speed. Then, the rear end of the instant film sheet is detected, and the film signal FILM_PI changes from low (L) to high (H). Subsequently, the cam switch signal CAMSW changes from low (L) to high (H). After a lapse of chattering time t7 of the cam switch signal CAMSW, the MPU 101 changes the motor drive signal DMDRV from high (H) to low (L). This ends a sequence of operations of the printer 1.

Figure 11:
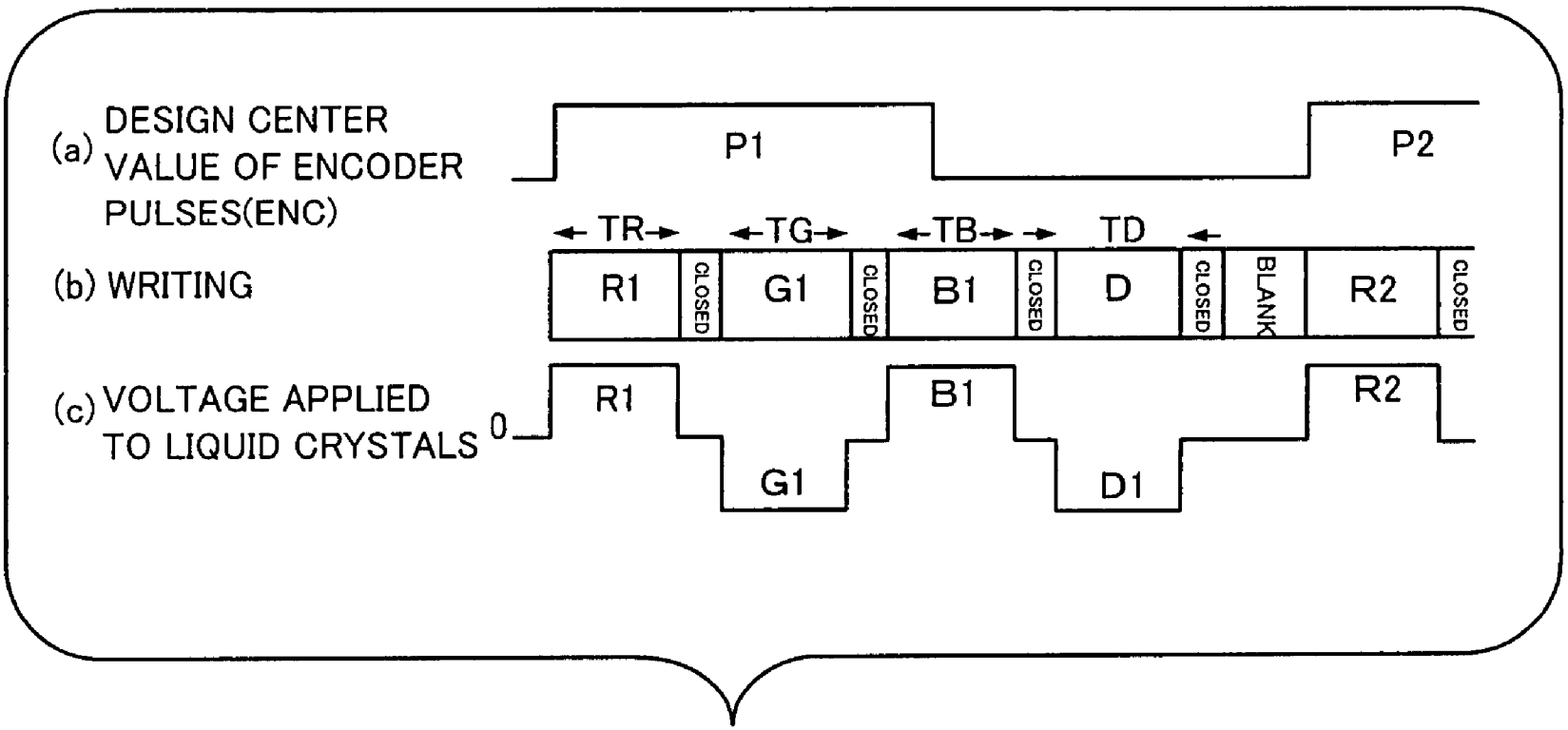
FIG. 11 is a diagram showing a relationship between an encoder signal ENC outputted from the ENCPI section shown in FIG. 8 and a write operation by an image write section.
Figure 12:
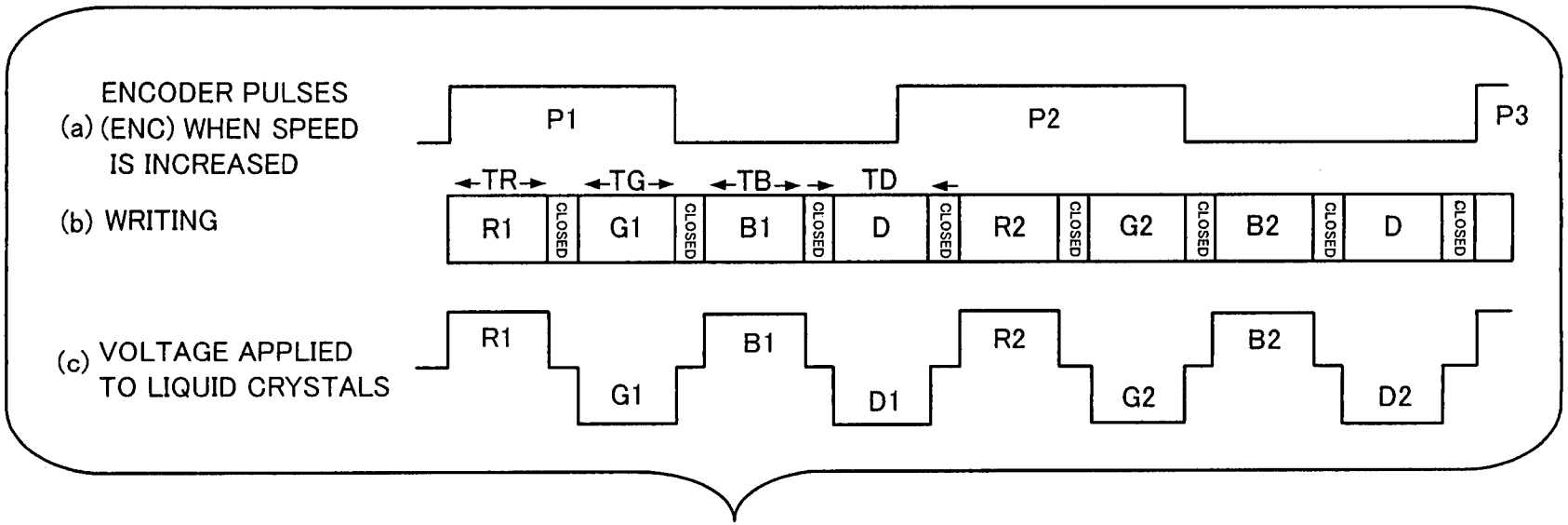
FIG. 12 is a diagram showing a relationship between an encoder signal ENC and write operation by an image write section which writes a color selected from among three colors of R, G, and B each time it receives a pulse in the case where normally-black liquid crystal shutters are used.

FIGS. 11 and 12 are diagrams showing a drive signal applied to normally-black liquid crystal shutters 3010 by the IrDA/LCS control section 114 via the flexible cable 302. As in the case of FIGS. 1 and 2, FIGS. 11 and 12 show a relationship among an encoder signal ENC, the IrDA/LCS control section 114, and a write operation by the image write section 300 which writes a round of three colored lights—R, G, and B—each time it receives a pulse of the encoder signal. FIGS. 11 and 12 correspond to FIGS. 1 and 2 which show a conventional example, but in FIGS. 11 and 12, a dummy operation D1 is performed for a predetermined time (denoted by TD in the figures) during a blank period, i.e., during a wait period for a next write command pulse.

Figure 1:
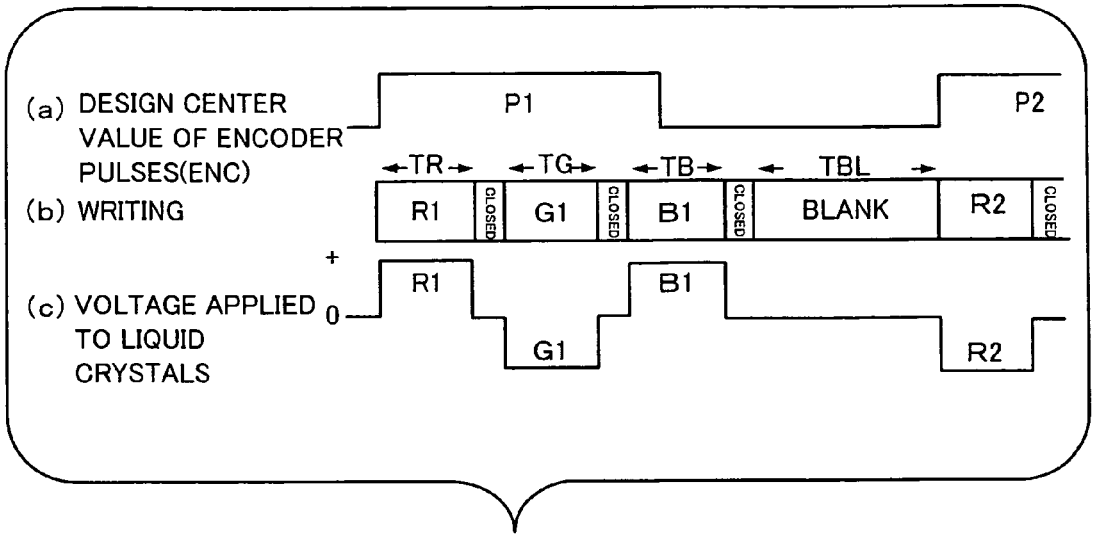
FIG. 1 is an excerpt from drawings attached to Japanese Patent Application No. 2004-070317.
Figure 2:
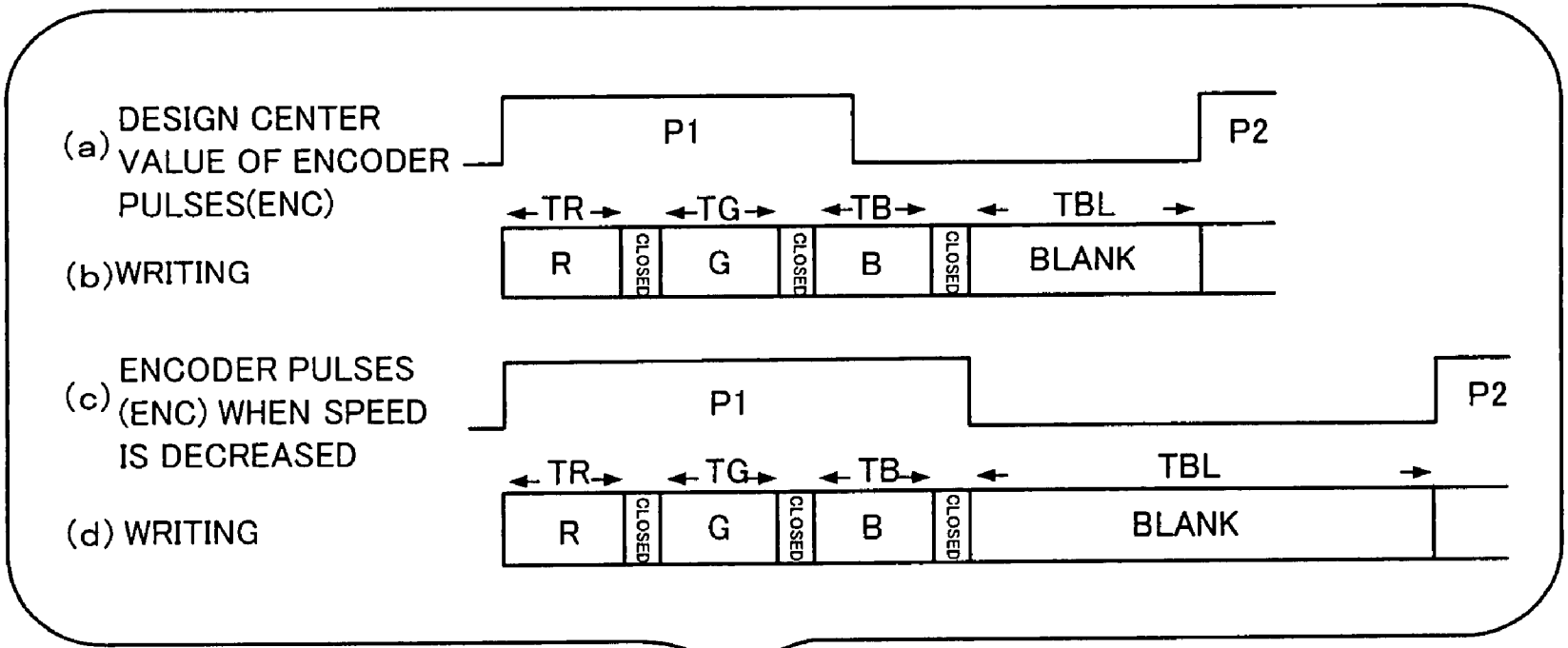
FIG. 2 is a diagram illustrating a drive condition when transport speed of an instant film sheet is decreased.
Figure 3:
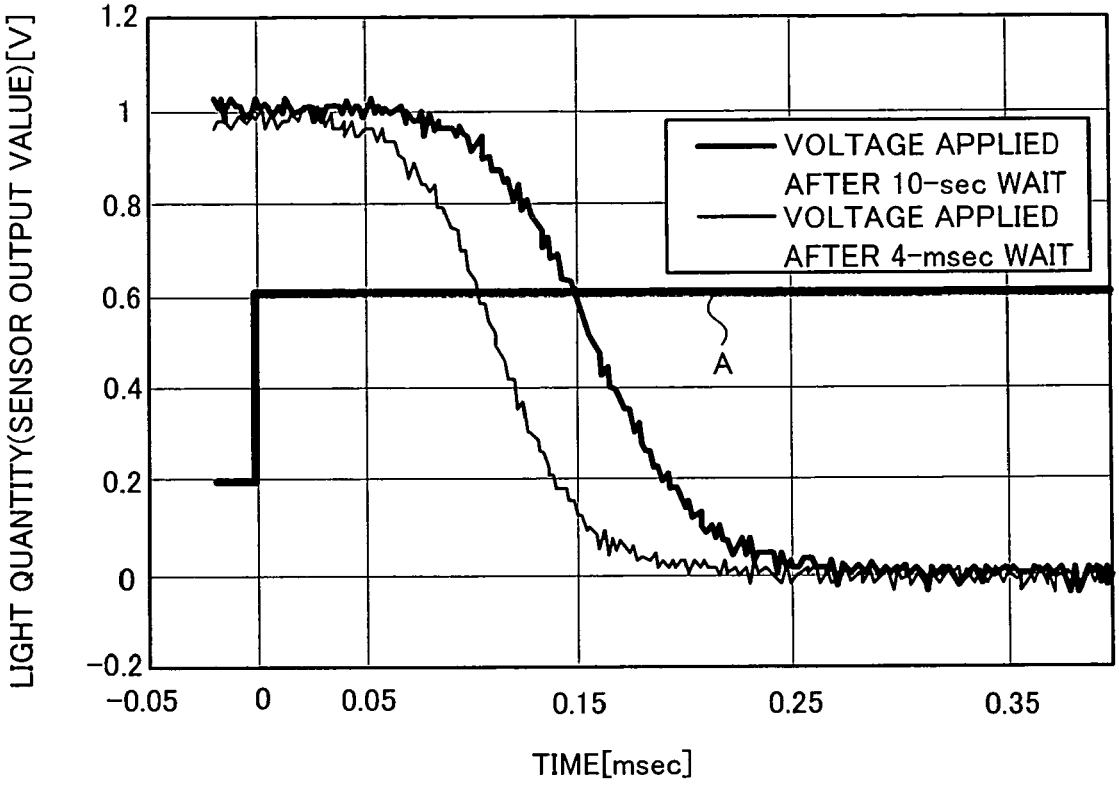
FIG. 3 is a diagram showing how a response of a liquid crystal shutter varies with the length of a wait period.

The MPU 101 makes the IrDA/LCS control section 114 open and close the liquid crystal shutters 3010 and emit colored lights in quantities corresponding to image data as in the case of FIGS. 1 and 2, and then makes the LED drive control section 114 perform a dummy operation (opening operation, in this case) for the time TD with the three LEDs 304, 305, and 306 kept off. In so doing, the drive time TD for the dummy operation is equal to the drive time TB immediately before the dummy operation and a negative voltage (D1) opposite to a positive voltage (B1) is applied, and thus it is not likely that the effect of one polarity appears more prominently in the liquid crystal shutters as is conventionally the case.

Also, as shown in FIG. 12, when the transport speed of an instant film sheet is decreased, if a next write command pulse is received while the liquid crystal shutters 3010 are open during the wait period, the MPU 101 and IrDA/LCS control section 114 which constitute the shutter control section close liquid crystal shutters 3010 after keeping them open for a predetermined period of time.

This ensures that the liquid crystal shutters 3010 are operated during the wait period, reducing delays in the response of the liquid crystals. Furthermore, since colored lights are emitted cyclically from the LEDs 304, 305, and 306 and a voltage of the same polarity is used for the same color (always positive polarity for R, negative polarity for G, and positive polarity for B) with a dummy operation inserted so that an even number of shutter operations will be performed in total, it is possible to emit each colored light in such a way as to keep the molecular arrangement in the liquid crystals constant.

In this way, by keeping the molecular arrangement in the liquid crystals constant, it is possible to drive the liquid crystals always under the same conditions. Also, since the liquid crystals continue to be driven, it is possible to avoid delays in the response of the liquid crystals due to a long wait period.

Since the amount of exposure is kept constant even if the transport speed changes due to load changes during transport of an instant film sheet, color irregularities in color images are eliminated.

If the drive time TD for a dummy operation is equal to the drive time TB immediately before the dummy operation as in the above example, it may not be possible to drive the shutter if the shutter remains closed in the operation immediately before the dummy operation. Thus, it is advisable to perform a dummy operation using the time (TR+TB−TG) obtained by subtracting the even-numbered drive time TG from the sum of odd-numbered drive times (TR+TB) as TD.

This ensures that the liquid crystal shutters are driven during await period (blank period), almost eliminating delays in the response of the liquid crystals, driving liquid crystals for the same color with a voltage of the same polarity, and thereby making it possible to drive the liquid crystal shutters with the molecular arrangement in the liquid crystals kept constant.

Figure 13:
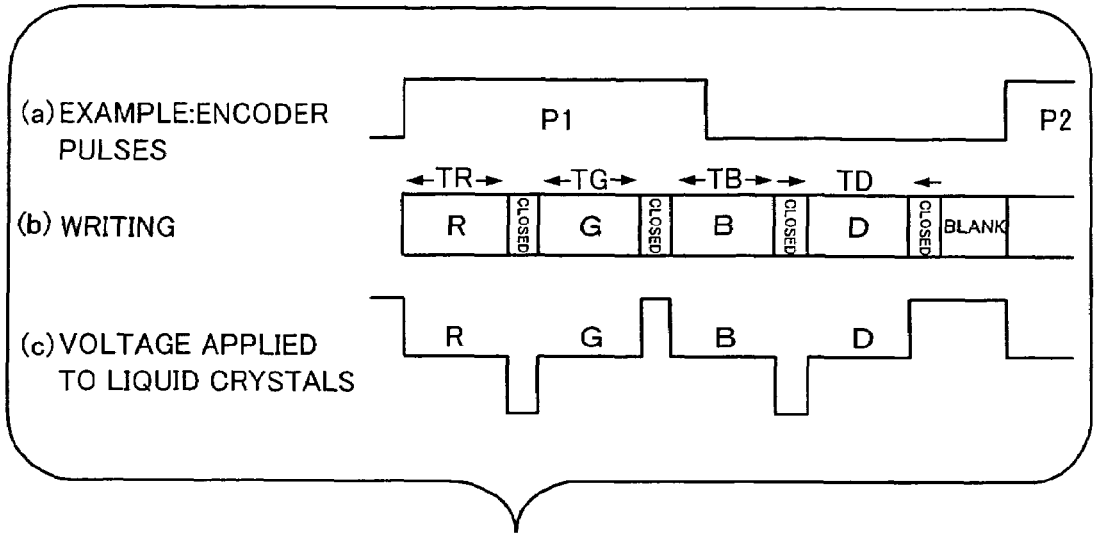
FIG. 13 is a diagram showing a relationship between an encoder signal ENC outputted from the ENCPI section shown in FIG. 8 and a write operation by an image write section.
Figure 14:
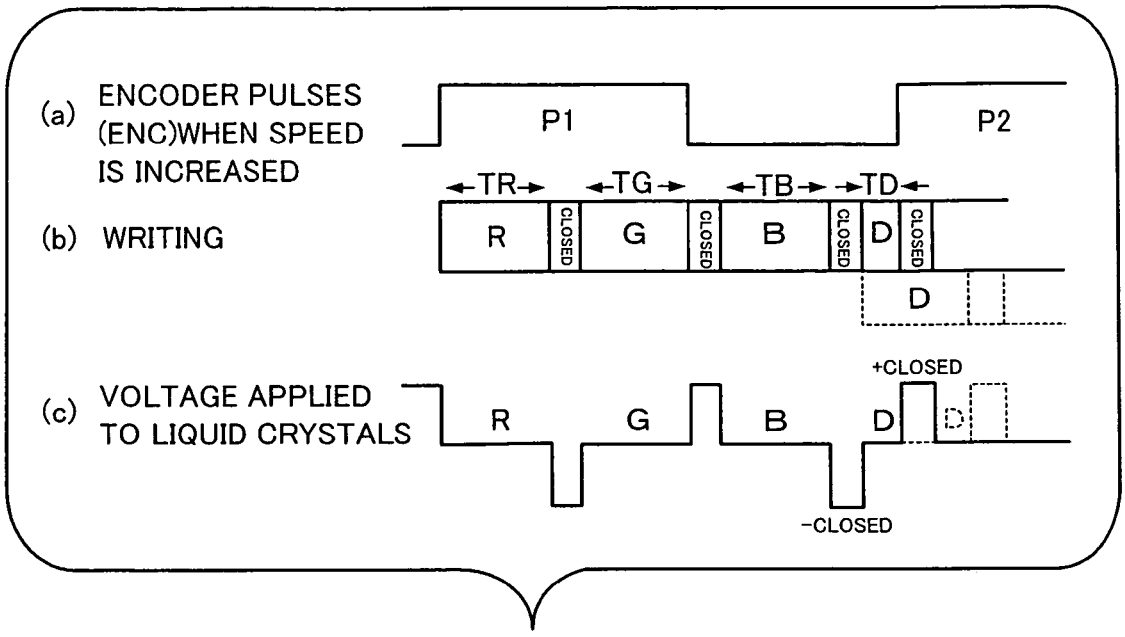
FIG. 14 is a diagram showing a relationship between an encoder signal ENC and write operation by an image write section which writes a color selected from among three colors of R, G, and B each time it receives a pulse in the case where normally-white liquid crystal shutters are used.

FIGS. 13 and 14 are diagrams showing a drive signal applied to normally-white liquid crystal shutters 3010 by the IrDA/LCS control section 114 via the flexible cable 302. They correspond to FIGS. 1 and 2 and FIGS. 11 and 12.

Unlike the normally-black liquid crystal shutters in FIGS. 11 and 12, the normally-white liquid crystal shutters in FIGS. 13 and 14 remain closed when a voltage is applied to them, and remain open when no voltage is applied to them.

Therefore, when the liquid crystal shutters are open in the wait period, no voltage is applied between their electrodes, i.e., they remain in a field-free state.

In the case of normally-white liquid crystal shutters, when the transport speed increases (or decreases), the liquid crystal shutters may be closed (indicated by dotted lines in FIG. 14) after being held open for a while as in the case of FIG. 13 assuming that the transport speed will increase (or decrease) under feedback control, or alternatively the liquid crystal shutters may be closed immediately as indicated by solid lines in FIG. 14 to adjust the molecular arrangement in the liquid crystal shutters by forming an electric field between the electrodes by application of a voltage.

Thus, if the liquid crystal shutters are set to be driven according to their type, the MPU 101 and IrDA/LCS control section 114 can drive the liquid crystal shutters according to whether they are a normally-white type or normally-black type.

Incidentally, when it is likely that a printer may use any of the two types of liquid crystal, a program for driving normally-white liquid crystals and program for driving normally-black liquid crystals can be stored in a flash memory and a switching section (e.g., a jumper) can be installed to switch between the programs. Then, the printer can be operated suitably according to the type of liquid crystal mounted on the printer by switching the type of liquid crystal with the jumper.

Although in this embodiment, the present invention is applied to a printer which uses instant film sheets, this is not restrictive. The present invention is applicable to any printer which records a color image on a recording medium by cyclically writing multiple colors on the recording medium in a predetermined sub-scanning direction while feeding the recording medium for use to record the image in the sub-scanning direction by a motor. It is also applicable, for example, to displays, provided they use liquid crystals.

What is claimed is:

1. A printer which records a color image on a recording medium, by irradiating the recording medium cyclically with a plurality of colors while relatively feeding the recording medium for use to record the image in a predetermined direction by a motor, comprising:

a light emitter which emits a plurality of different colored lights;

a liquid crystal shutter which is placed on an optical path shared by the plurality of colored lights emitted by the light emitter and controls irradiation of the recording medium with the colored lights by opening and closing by application of a voltage;

a pulse generating section which generates write command pulses synchronized with rotation of the motor;

an emission control section which makes the light emitter illuminate with the plurality of colored lights in sequence upon receiving one of write command pulses generated by the pulse generating section, and keeps the light emitter off during a wait period for a next write command pulse after a round of illumination with the plurality of colored lights is completed;

a shutter control section which controls the opening and closing of the liquid crystal shutter in synchronization with the sequential illumination of the light emitter with the plurality of colored lights so as to open the liquid crystal shutter individually for each colored light for a duration in accordance with an image signal as well as opens and closes the liquid crystal shutter even during the wait period; and wherein the shutter control section sets an open period of the liquid crystal shutter during the wait period equal to an open period of the liquid crystal shutter immediately before the wait period.

2. The printer, according to claim 1, wherein the light emitter emits an odd number of colored lights.

3. The printer, according to claim 1, wherein the light emitter emits three colored lights of red, green, and blue.

4. The printer, according to claim 3, wherein the light emitter is constituted of three LEDs which emit colored lights of red, green, and blue, respectively.

5. The printer, according to claim 1, wherein if a next write command pulse is received while the liquid crystal shutter is open during the wait period, the shutter control section closes the liquid crystal shutter according to the next write command pulse.

6. The printer, according to claim 5, wherein when the next write command pulse is received, the emission control section starts illuminating the light emitter in sequence after the liquid crystal shutter is closed.

7. The printer, according to claim 1, wherein if a next write command pulse is received while the liquid crystal shutter is open during the wait period, the shutter control section closes the liquid crystal shutter after keeping the liquid crystal shutter open for a predetermined period of time.

8. A printer which records a color image on a recording medium, by irradiating the recording medium cyclically with a plurality of colors while relatively feeding the recording medium for use to record the image in a predetermined direction by a motor, comprising;

a light emitter which emits a plurality of different colored lights;

a liquid crystal shutter which is placed on an optical path shared by the plurality of colored lights emitted by the light emitter and controls irradiation of the recording medium with the colored lights by opening and closing by application of a voltage;

a pulse generating section which generates write command pulses synchronized with rotation of the motor;

an emission control section which makes the light emitter illuminate with the plurality of colored lights in sequence upon receiving one of write command pulses generated by the pulse generating section, and keeps the light emitter off during a wait period for a next write command pulse after a round of illumination with the plurality of colored lights is completed; and a shutter control section which controls the opening and closing of the liquid crystal shutter in synchronization with the sequential illumination of the light emitter with the plurality of colored lights so as to open the liquid crystal shutter individually for each colored light for a duration in accordance with an image signal as well as opens and closes the liquid crystal shutter even during the wait period;

wherein the light emitter emits three colored lights of red, green, and blue;

wherein the light emitter is constituted of three LEDs which emit colored lights of red, green, and blue, respectively; and wherein the shutter control section sets an open period of the liquid crystal shutter during the wait period equal to the difference between the sum of open periods for odd-numbered colored lights and sum of open periods for even-numbered colored lights in a round of illumination with the colored lights immediately before the wait period.

9. An illuminating device which irradiates a target body cyclically with a plurality of colors, comprising:

a light emitter which emits a plurality of different colored lights;

a liquid crystal shutter which is placed on an optical path shared by the plurality of colored lights emitted by the light emitter and controls irradiation of the target body with the colored lights by opening and closing by application of a voltage;

an emission control section which makes the light emitter illuminate with the plurality of colored lights in sequence upon receiving one of predetermined timing pulses, and keeps the light emitter off during a wait period for a next write command after a round of illumination with the plurality of colored lights is completed;

a shutter control section which controls the opening and closing of the liquid crystal shutter individually for each colored light in synchronization with the sequential illumination of the light emitter with the plurality of colored lights as well as opens and closes the liquid crystal shutter even during the wait period; and wherein the shutter control section sets an open period of the liquid crystal shutter during the wait period equal to an open period of the liquid crystal shutter immediately before the wait period.

* * * * *